US005863505A

United States Patent [19]

Wada et al.

[11] Patent Number: 5,863,505

[45] Date of Patent: Jan. 26, 1999

[54] UNDERGROUND-ENVIRONMENT SIMULATOR

[75] Inventors: Ryutaro Wada; Makoto Asao; Tsutomu Nishimura, all of Osaka; Toshio Iwata, Tokyo; Kenji Yamaguchi, Osaka; Kiyoshi Tsune, Kobe, all of Japan

[73] Assignee: Kabushiki Kaisha Kobe Seiko Sho, Kobe, Japan

[21] Appl. No.: 862,920

[22] Filed: May 27, 1997

[30] Foreign Application Priority Data

May 30, 1996 [JP] Japan ..... 8-158891
May 28, 1996 [JP] Japan ..... 8-157634

[51] Int. Cl.[6] ..... A61G 11/00

[52] U.S. Cl. ..... 422/83; 422/110; 422/116; 312/1

[58] Field of Search ..... 312/1; 2/16, 158, 2/159, 270; 34/242; 422/83, 111, 112, 116, 110

[56] References Cited

U.S. PATENT DOCUMENTS 3,907,389 9/1975 Cox et al. ..... 312/1

*Primary Examiner*—Lyle A. Alexander

*Attorney, Agent, or Firm*—Oblon, Spivak, McClelland, Maier & Neustadt, P.C.

[57] ABSTRACT

The present invention provides an underground-environment simulator which simulates underground environment spaces used for radioactive waste disposal or the like, and has a hermetic box, wherein the carbon dioxide gas concentration inside the box can be adjusted to an optional level, and the atmosphere inside the box can be uniformly and stably maintained. In the underground-environment simulator of the present invention, a carbon dioxide gas feeding means feeds carbon dioxide gas into a circulating gas circulation which controls the atmosphere inside the hermetic box, and the concentration of carbon dioxide gas in the circulating gas is measured and adjusted to a predetermined level while oxygen is removed from the circulating gas in an oxyhydrogen reactor. Accordingly, the carbon dioxide gas concentration can be controlled within a low concentration range, and various underground environments can be accurately simulated by varying the carbon dioxide gas concentration to an optional level.

9 Claims, 8 Drawing Sheets

CONDENSED WATER
COMPUTER
GAS CONCENT-RATION MONITOR
LIC
TI
TIC
TI
TIC
CWa Wa
N2/H2 GAS
FIC
FIC
LOW O2 MONITOR
PI
CO2 GAS
CO2 ABSORBER
FI
N2 GAS
HIGH O2 MONITOR
OFFGAS
PIC
PIC
N2 GAS
FACILITY-OFFGAS LINE
1
1a
1b
2
4
5
6
7
9
10
11
12
14
15a
17
18
19
21
22
23
25
26
27
28
29
30
31
32
33a
33b
34
35
36
37
38
39
40
41
42
43

UNDERGROUND-ENVIRONMENT SIMULATOR

BACKGROUND OF THE INVENTION

1. Field of the Invention

The present invention relates to an underground-environment simulator which simulates underground environment spaces used for radioactive waste disposal or the like. More particularly, the present invention relates to an underground-environment simulator having a box whose atmosphere is controllable, and being substantially free from stagnation of the gas flow inside the box.

2. Description of the Related Art

Recently, various investigations are being conducted concerning disposal of highly radioactive wastes derived from the nuclear fuel cycle. In such investigations, there is an increasing demand for actualizing, in a simulating manner, an underground environment (with a low oxygen concentration and an optional low carbon dioxide gas concentration) at a depth of a few hundred meters or more where such wastes are disposed, and performing experiments in such an environment.

Such experiments are carried out using a hermetic box, the atmosphere inside which can be isolated from the surroundings. When a radioactive material is treated in the box, the inside of the box is always maintained at a negative pressure in order to prevent external leakage of the radioactive material. For control of the atmosphere inside the box, an inlet pipe and an exhaust pipe are provided on an outer wall of the box, a gas-controlling unit is connected to such inlet pipe and exhaust pipe, and thus an underground-environment simulator is constructed.

Hitherto, in such an experimental facility, a vacuum state is achieved by exhausting the gas inside the hermetic box 51, or most parts of the oxygen and carbon dioxide gas are removed by feeding an inert gas such as nitrogen from an inert gas feeding unit 52 after the inside of the box is purged with nitrogen at ordinary pressure, as shown in FIG. 3. Subsequently, while the inert gas fed into the hermetic box 51 is circulated together with the remaining oxygen and carbon dioxide gas, the remaining oxygen is removed through a deoxygenating unit 53 provided in the circulation path. Further, moisture and the remaining carbon dioxide gas is removed through a water adsorbing unit 54 and a carbon dioxide gas adsorbing unit 55 which are connected in parallel. As a result, an underground environment at an extremely deep place with extremely low oxygen and carbon dioxide gas concentrations is achieved (cf. Japanese Unexamined Patent Publication No. 1-207748).

Actual underground environments, however, differ in carbon dioxide gas concentration according to depth and geological features, though the oxygen concentrations are similarly low substantially without being affected by temperature. When actual underground environments which differ in gas concentration as above should be more closely simulated, the above-described continuous removal of oxygen and carbon dioxide gas by circulation is insufficient. In particular, carbon dioxide gas concentration is a factor influencing experimental results of radioactive wastes greatly even with an only slight variations thereof, and highly accurate experiments require simulation of underground environments with controlled or varied carbon dioxide gas concentration.

Additionally, also in the hermetic box, the atmosphere is needed to be controlled so as to uniformly and stably retain a predetermined gas composition. However, merely adjusting the connecting positions of the gas inlet pipe and the exhaust pipe relative to the outer wall of the hermetic box could rarely achieve uniform distributions of the gases circulating in the box through these pipes. For example, a specific gas can be unevenly distributed at the corner portions of the box.

More particularly, such a hermetic box is provided with openings for gloves needed for experimental operations, a monitoring window, connecters for connecting external measuring equipment, and others, and these portions have sealing regions for preventing external air from entering. Although such sealing regions comprise sealing materials such as natural rubber, neobutylene, teflon, hydrochlorinated rubber and butyl rubber, oxygen in the air can permeate such sealing materials and enter into the inside of the box. In addition, since the inside of the box used for treatment of radioactive materials is set at a negative pressure, external air can leak into the box through the sealing regions when deterioration occurs thereat. As a result of leakage and entering of oxygen or the like by such permeation, gas concentrations readily become uneven in positions close to the internal walls of the box. Further, when drifting or whirling occurs in the gas flow inside the box, the internal atmosphere can rarely be controlled to maintain a predetermined composition during operation, and a long time period is needed for the start-up of operation to achieve a predetermined internal atmosphere.

SUMMARY OF THE INVENTION

Accordingly, the object of the present invention is to provide an underground-environment simulator having a hermetic box in which the carbon dioxide gas concentration can be adjusted to an optional level, and the atmosphere can be stably maintained at uniform conditions.

Aiming to achieve the above-described object, the underground-environment simulator according to the present invention comprises:

a hermetic box, the internal atmosphere of which is isolated from the surroundings and controlled with a circulating gas;

an inert gas feeding unit which feeds an inert gas into said circulating gas;

a concentration measuring means for measuring the concentration of each gas component in said circulating gas;

an oxyhydrogen reactor having a noble metal catalyst, in which hydrogen fed in response to the oxygen concentration in the circulating gas is reacted with the oxygen; and a carbon dioxide gas feeding means which feeds carbon dioxide gas into said circulating gas so as to achieve a predetermined carbon dioxide gas concentration in said circulating gas.

According to the above-described construction, while the oxyhydrogen reactor removes oxygen from the circulating gas composition, the carbon dioxide gas concentration in the circulating gas can be measured, and adjusted to a predetermined level by feeding carbon dioxide gas into the circulating gas. The carbon dioxide gas concentration thus can be controlled within a low concentration range, and various underground environments can be accurately simulated by varying the carbon dioxide gas concentration at an optional level.

Preferably, the hermetic box should be prismatic, and equipped with a gas feeding means at a lower portion of the prismatic structure and a gas exhausting means at an upper portion of the prismatic structure, wherein the gas feeding means is composed so as to generate an upward gas flow along the internal surfaces of at least two upright walls of the box. Hereupon, the term "prismatic" means "squarish" or "angular", and typical examples of "prismatic" three-dimensional bodies include those comprising six panels, i.e. a bottom panel, a top panel, a front panel, a back panel, a left panel and a right panel. Such "prismatic" three-dimensional bodies also include parallelepipeds in which each pair of adjacent panels form a right angle; three-dimensional bodies comprising such six panels in which the front panel slants relative to the bottom and top panels; three-dimensional bodies comprising such six panels in which the front panel partially slants relative to the top panel; and others. Further, the term "upright wall" means a wall such as the front, back, left or right panel constituting such a prismatic three-dimensional body.

If an upward gas flow is generated from a lower position of an upright wall along its internal surface, oxygen and other gases which enter the box through the panel surfaces and tend to stay near the panel surfaces can be forcedly circulated.

Additionally, when the gas feeding means is disposed so as to form an agitating gas jet at least one corner in the upper portion of the prismatic structure of the hermetic box, the upward gas flow from the lower position of the upright wall along its internal surface can be agitated near the corner in the upper portion of the prismatic structure.

Further, the upper portion of the prismatic structure preferably slants so that the gas flow can readily curve. According to this manner, the gas flow will not be drifted at the upper portions of the prismatic structure.

Moreover, the gas feeding means is preferably a pipe which is disposed at a corner of the prismatic structure, and has gas-jetting orifices formed along the pipe. By controlling the direction of the orifices on the pipe, the feed gas can be jetted in a predetermined direction. Additionally, an even gas flow along the internal surface of an upright wall can be generated by jetting the feed gas from a larger number of gas-jetting orifices.

Furthermore, when the portion of the pipe inside the prismatic structure is disposed so as to be rotatable, the direction of the gas-jetting orifices can be varied at will, and the direction of the jet gas can be varied in a predetermined direction.

Further, when the oxyhydrogen reactor is equipped with a heating means, the noble metal catalyst and the circulating gas can be heated to sufficiently prevent adsorption of carbon dioxide gas onto the noble metal catalyst. Accordingly, the carbon dioxide gas concentration can be finely controlled at an extremely low level such as 100 ppm or below.

Additionally, the noble metal catalyst in the oxyhydrogen reactor preferably comprises an inorganic carrier having a specific surface of 250 $m^2/g$ or less. By using an inorganic carrier for the noble metal catalyst, carbon dioxide gas adsorption onto the noble metal catalyst can be sufficiently prevented, and the carbon dioxide gas concentration can be finely controlled at an extremely low level, such as 100 ppm or below.

Further, excessive hydrogen is preferably fed into the circulating gas to generate methane through a side reaction between hydrogen and carbon dioxide gas in the oxyhydrogen reactor so that the methane concentration can be controlled at will. More accurate underground environments can be simulated by achieving a function of generating methane which may be present in underground environments.

DESCRIPTION OF THE PREFERRED EMBODIMENT

A preferred embodiment of the present invention will be illustrated below with reference to FIG. 1.

Figure 1:
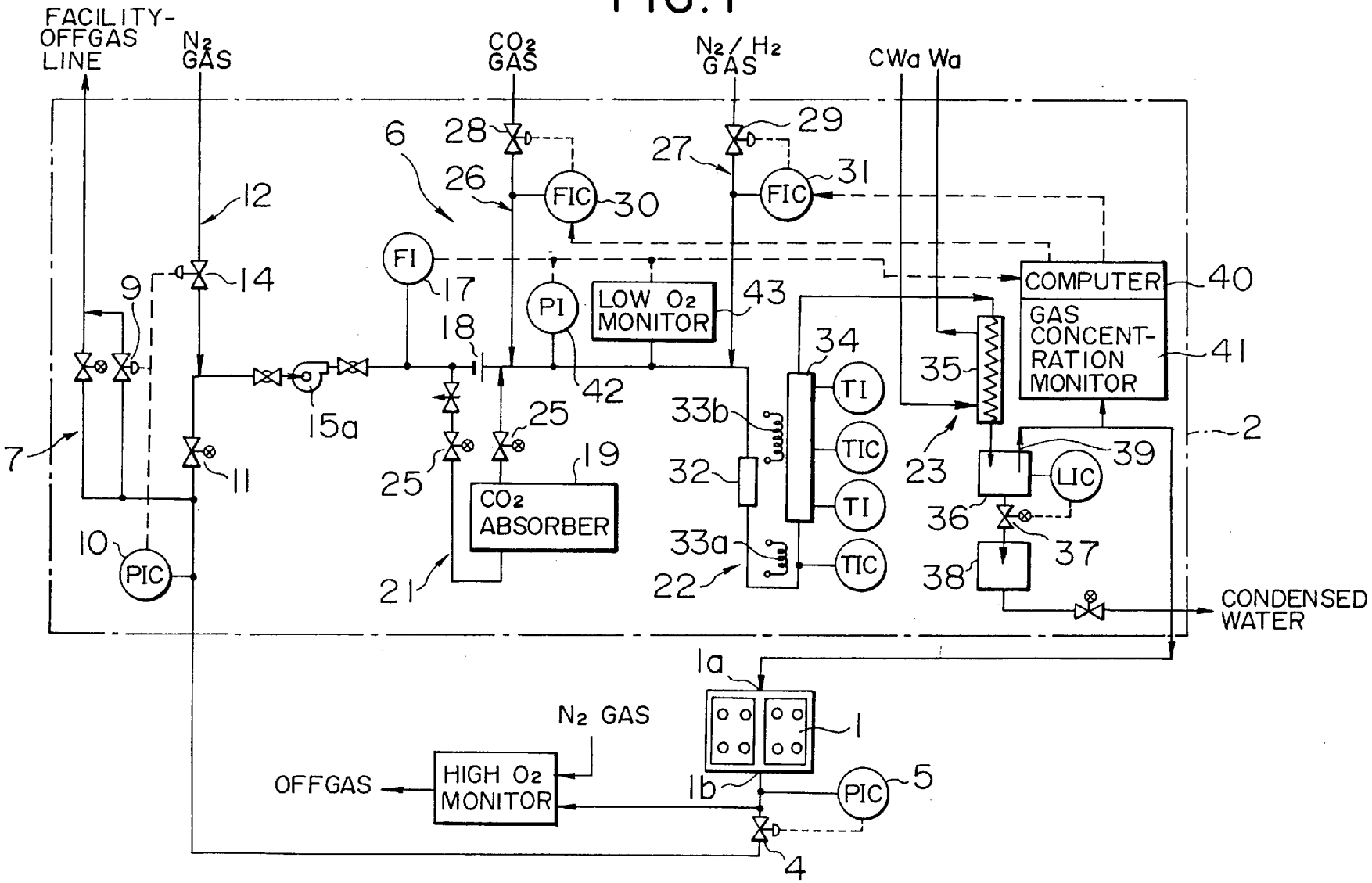
FIG. 1 shows the construction of an example underground-environment simulator according to the present invention.

As shown in FIG. 1, the underground-environment simulator according to the present invention has a hermetic box 1, the atmosphere in which is isolated from the surroundings; and a gas circulator 2 which feeds and withdraws predetermined gases such as carbon dioxide ($CO_2$) and nitrogen ($N_2$). The hermetic box 1 is provided with an inlet 1*a* and an outlet 1*b* which are connected to the gas circulator 2. On the pipeline between the outlet 1*b* and the gas circulator 2, an exhaust controlling valve 4 and exhaust gas pressure controller 5 are disposed such that the exhaust gas pressure controller 5 monitors the gas pressure derived from the hermetic box 1, and the monitored gas pressure is adjusted into a predetermined gas pressure by adjusting the opening amount of the exhaust controlling valve 4.

Further, the exhaust controlling valve 4 is connected to the inlet side of the gas circulation line 6 of the gas circulator 2. On the inlet side of the gas circulation line 6, the following items are disposed in the described order from the inlet side: A circulating gas pressure controller 10 which monitors the gas pressure; an offgas exhausting line 7 which externally exhausts the circulating gas containing gas components such as carbon dioxide gas; a circulating line opening/closing valve 11 which can stop the gas circulation; and a $N_2$ gas feeding line 12 (inert gas feeding part) which feeds nitrogen gas into the gas circulation line 6.

Hereupon, the nitrogen ($N_2$) gas feeding line 12 has a nitrogen ($N_2$) gas controlling valve 14, the opening amount of the $N_2$ gas controlling valve 14 is adjusted by the above-described circulating gas pressure controller 10 while being interlocked with an offgas controlling valve 9, and thus nitrogen gas is fed into the gas circulating line 6 in an amount which is in proportion to the opening amount of the valve. The circulating gas to which nitrogen gas is fed from the nitrogen ($N_2$) gas feeding line 12 in this manner is made to flow into a gas compressor system 20. The gas compressor system 20 has a blower 15*a*.

Succeeding to the gas compressor system 20, a carbon dioxide gas absorption system 21 is disposed, in which carbon dioxide gas in the circulating gas is absorbed. The carbon dioxide gas absorption system 21 has an orifice 18 and a $CO_2$ absorber 19 connected to the orifice 18 in parallel. Further, valves 25 are disposed on the inlet line and the outlet line of the $CO_2$ absorber 19. In the carbon dioxide gas absorption system 21, when the $CO_2$ concentration should be maintained at a level below 1 ppm, the valves 25 are opened or closed in response to the operation parameters, such as the $CO_2$ concentration in the circulating gas, and the carbon dioxide gas in the circulating gas is absorbed by the $CO_2$ absorber 19 while the valves are opened.

Additionally, a $CO_2$ gas feeding line 26 (included in the carbon dioxide gas feeding means) and a mixed gas ($N_2/H_2$) feeding line 27 are disposed subsequent to the carbon dioxide gas absorption system 21. The $CO_2$ gas feeding line 26 and the mixed gas ($N_2/H_2$) feeding line 27 are equipped with a $CO_2$ controlling valve 28 and a $N_2/H_2$ controlling valve 29, respectively, and in addition, a $CO_2$ gas flow controller 30 and a $N_2/H_2$ gas flow controller 31, respectively. The $CO_2$ gas flow controller 30 functions to achieve a concentration of carbon dioxide gas present in the circulating gas predetermined by an operator, namely, it serves as adjusting the opening amount of the $CO_2$ controlling valve 28 to a level in accordance with a command value from a below-described information processor 40 (included in the carbon dioxide gas feeding means) such as a personal computer, and carbon dioxide gas is thereby fed into the circulating gas at a gas flow rate in accordance with the command value. Meanwhile, the $N_2/H_2$ gas flow controller 31 functions to adjust the opening amount of the $N_2/H_2$ controlling valve 29 in accordance with a command value from the information processor 40. When methane gas generation is required, the mixed gas ($N_2/H_2$) feeding line 27 is opened with a large amount of the valve opening to further excessively feed the $N_2/H_2$ gas relative to the oxygen concentration, and methane gas is generated through a side reaction between carbon dioxide gas and hydrogen gas in a below-described oxyhydrogen reactor 34.

Further, the above-described circulating gas is made to flow into an oxyhydrogen reaction system 22 in which oxygen and hydrogen in the circulating gas are reacted ($2H_2+O_2 \rightarrow 2H_2O$) to remove the oxygen. The oxyhydrogen reaction system 22 has in its early stage a gas mixer 32 which mixes the carbon dioxide gas and the $N_2/H_2$ gas fed into the circulating gas. In its later stage succeeding to the gas mixer 32, a preheater 33*a* (included in the heating means) for heating the circulating gas and an oxyhydrogen reactor 34 for reacting oxygen and hydrogen in the circulating gas are provided in the described order. The oxyhydrogen reactor 34 contains a noble metal catalyst comprising an inorganic carrier in order to promote the oxyhydrogen reaction, wherein the inorganic carrier is designed for prevention of carbon dioxide gas adsorption onto the noble metal catalyst so as to have a specific surface of 250 $m^2/g$ or less, and preferably, 100 $m^2/g$ or less.

Figure 2:
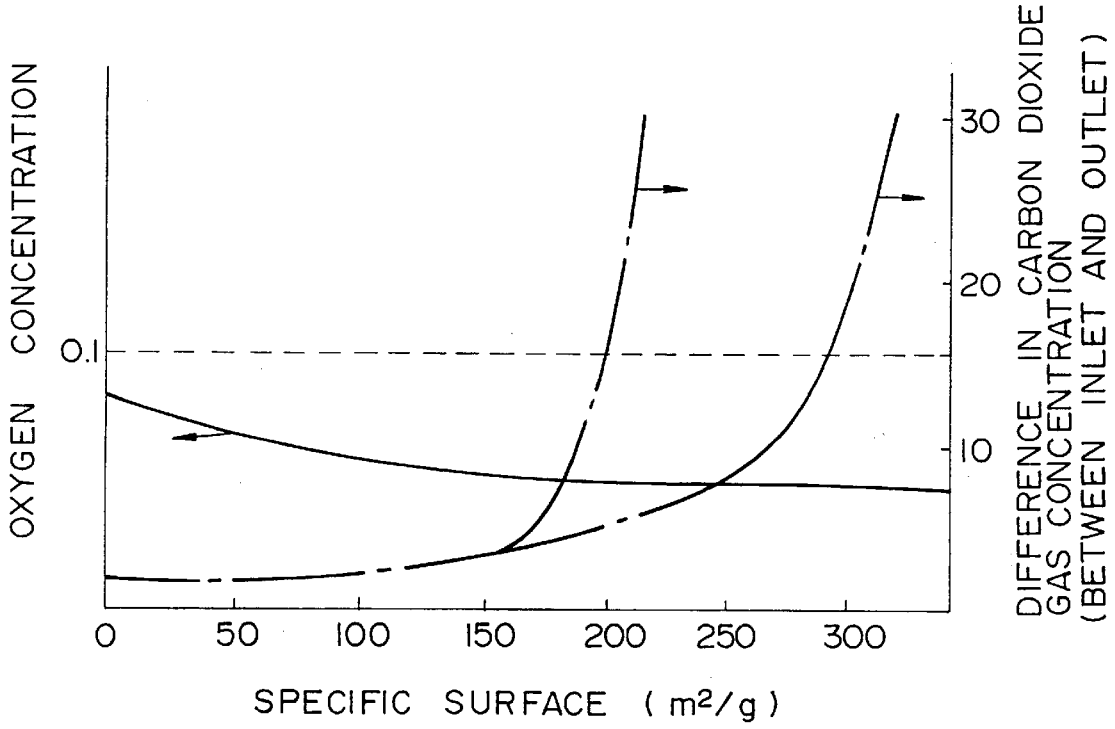
FIG. 2 is a graph showing the relationships between the specific area of the carrier of a noble metal catalyst and the oxygen concentration (at a column inlet) and between the former and the difference in carbon dioxide gas concentration (between a column inlet and a column outlet)
Figure 3:
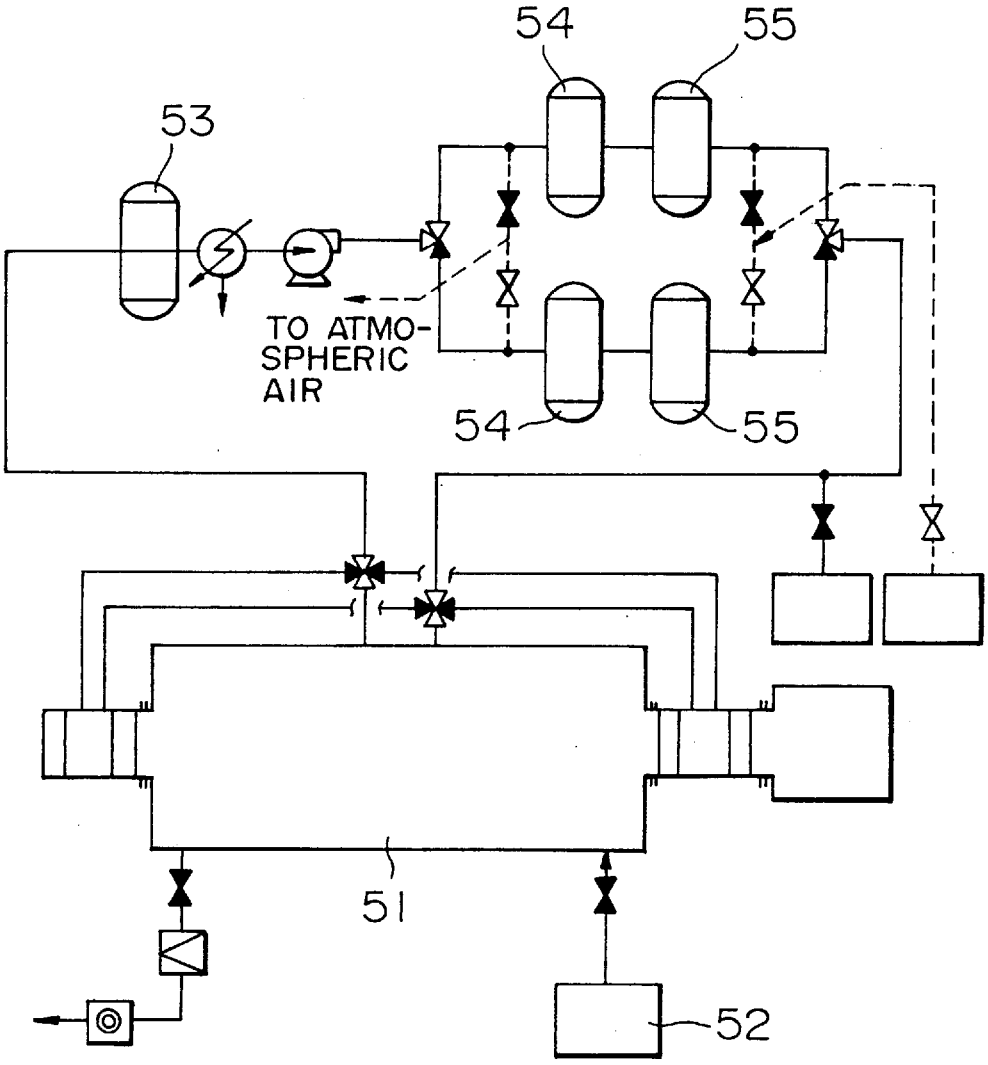
FIG. 3 PRIOR ART
FIG. 3 shows the construction of a conventional underground-environment simulator.

Incidentally, a material selected from the group consisting of sintered silica, alumina and SiC, and a combined material comprising two or more of these can be used as the inorganic carrier. Further, the term "specific surface" is the surface area of a particle per unit mass, and therefore, if catalysts are made of the same material, the catalyst having a larger specific surface can exhibit a higher activity. Additionally, relationships as shown in FIG. 2 exist between the specific surface of a carrier of a noble metal catalyst and the oxygen concentration (at a column inlet) and between the former and the difference in carbon dioxide gas (between a column inlet and a column outlet). When the specific surface of the carrier is 250 $m^2/g$ or below as in this embodiment, the oxygen concentration can be maintained at a level of 0.1 ppm or below, and the difference in carbon dioxide gas concentration caused due to adsorption of carbon dioxide gas can be restricted to a few ppm or below. As a result, the reactor can be sufficiently practical. Moreover, when the specific surface of the carrier is 100 $m^2/g$ or below, the reactor can possess extremely superior stability.

Actually, as shown in Table 1, in a case of using α alumina carrier particles having specific surfaces of 0 to 10 $m^2/g$, the oxygen concentration at the inlet was 0.05 ppm, the carbon dioxide concentration at the inlet was 12.35 ppm, the carbon dioxide concentration at the outlet was 8.45 ppm, and therefore, the difference in carbon dioxide concentration was 3.9 ppm. Meanwhile, in a case of using spherical SiC carrier particles having specific surfaces of 0 to 10 $m^2/g$, the oxygen concentration at the inlet was 0.1 ppm, the carbon dioxide concentration at the inlet was 4.55 ppm, the carbon dioxide concentration at the outlet was 4.52 ppm, and therefore, the difference in carbon dioxide concentration was 0.03 ppm. Further, in a case of using spherical SiC carrier particles having specific surfaces of 100 $m^2/g$ or less, the oxygen concentration at the inlet was 0.06 ppm, the carbon dioxide concentration at the inlet was 4.78 ppm, the carbon dioxide concentration at the outlet was 4.73 ppm, and therefore, the difference in carbon dioxide concentration was 0.05 ppm. In contrast, in a case of using γ alumina carrier particles having specific surfaces of 200 to 300 $m^2/g$, the oxygen concentration at the inlet was 0.05 ppm, the carbon dioxide concentration at the inlet was 20 ppm, the carbon dioxide concentration at the outlet was 0 ppm, and therefore, the difference in carbon dioxide concentration was 20 ppm.

TABLE 1

| Type of Carrier | Specific Surface ($m^2/g$) | Oxygen Concentration at Inlet (ppm) | Carbon Dioxide Concentration Inlet (ppm) | Carbon Dioxide Concentration Outlet (ppm) | Difference in Carbon Dioxide Concentration (ppm) |
|---|---|---|---|---|---|
| α Alumina | 0–100 | 0.05 | 12.35 | 8.45 | 3.9 |
| Spherical SiC | 0–100 | 0.1 | 4.55 | 4.52 | 0.03 |
| Sintered Silica | ≦ 100 | 0.06 | 4.78 | 4.73 | 0.05 |
| γ Alumina | 200–300 | 0.05 | 20 | 0 | 20 |

In a position adjacent to the oxyhydrogen reactor 34 containing the above-described carrier, a main heater 33*b* (included in the heating means) is disposed for heating the noble metal catalyst and the circulating gas. This main heater 33*b* and the preheater 33*a* heat the circulating gas and the noble metal catalyst to a desired temperature in order to sufficiently prevent adsorption of carbon dioxide gas onto the noble metal catalyst. Preferably, the temperature to which the noble metal catalyst is heated by the main heater 33*b* and the preheater 33*a* should fall within a range of 100° to 800° C. The temperature of 100° C. is the boiling point of water at ordinary atmospheric pressure, and the lower limit for utilizing water in the form of vapor. Meanwhile, with a temperature above 800° C., meltdown of metal occurs in the noble metal catalyst.

Subsequent to the oxyhydrogen reactor 34, a steam separation system 23 is provided, in which water generated in the oxyhydrogen reaction system 22 is separated and removed from the circulating gas. The steam separation system 23 has a condenser 35 in its early stage. The condenser 35 cools the circulating gas heated in the oxyhydrogen reaction system 22 to condense water molecules produced in the circulating gas. In the later stage succeeding to the condenser 35, a steam separator 36 is disposed which separates the condensed water and the circulating gas into a lower phase and an upper phase, respectively. Additionally, a drain tank 38 is connected to the bottom of the steam separator 36 through a drain valve 37 which is opened to drain out water in the steam separator 36 into the drain tank 38 when the water level in the steam separator 36 reaches a predetermined height. Meanwhile, a gas-discharging pipe 39 is connected to the top of the steam separator 36. The gas-discharging pipe 39 serves as a path for discharging the dry circulating gas present in the upper phase of the steam separator 36 through the outlet of the gas circulation line 6, and for feeding the discharged circulating gas into the aforementioned hermetic box 1.

Additionally, a gas concentration monitor 41 (included in the concentration measuring means) for monitoring the concentrations of oxygen, hydrogen and carbon dioxide gas is connected to the gas-discharging pipe 39. The gas concentration monitor 41 is also connected to the information processor 40, and outputs information concerning each gas concentration into the information processor 40. Further, the information processor 40 receives input signals concerning gas-flow monitoring results from a flow monitor 17, and in addition, concerning the results of gas pressure and oxygen concentration monitoring from a gas-pressure monitor 42 and a low $O_2$ monitor 43, respectively, which are disposed between the carbon dioxide ($CO_2$) gas feeding line 26 and the mixed gas ($N_2/H_2$) feeding line 27. Moreover, the information processor 40 outputs commanding values into the $CO_2$ gas flow controller 30 and the $N_2/H_2$ gas flow controller 31 based on the monitoring results sent from the above gas concentration monitor 41 and the others in order to introduce carbon dioxide gas and $N_2/H_2$ gas into the circulating gas in accordance with the carbon dioxide gas concentration predetermined by an operator, and carries out various controlling processes and monitoring processes such as temperature regulation of the preheater 33*a* and main heater 33*b*.

Based on the above-described structure, the operation of the underground-environment simulator will be illustrated below.

Initially, an operator inputs a desired carbon dioxide concentration value into the information processor 40. Next, a command to operate the gas circulator 2 is input into the information processor 40, and the circulating gas present in the hermetic box 1 and the gas circulation line 6 is discharged into a facility-offgas line. After this, when a predetermined vacuum degree is achieved, a process for controlling the carbon dioxide gas concentration is started.

Specifically, the blower 15*a* in the gas compressor system 20 is driven while nitrogen gas is fed into the circulating gas from the nitrogen ($N_2$) gas feeding line 12, and thereby the circulating gas is recovered from the hermetic box 1 into the gas circulation line 6 of the gas circulator 2. When the predetermined carbon dioxide concentration value is too low to be controlled by the information processor 40, the valves 25 in the carbon dioxide gas absorption system 21 are opened to absorb carbon dioxide gas by the $CO_2$ absorber 19.

In contrast, when the carbon dioxide concentration value is predetermined within a controllable range, the valves 25 are left closed, and commanding values are output from the information processor into the gas flow controllers 30 and 31 in the carbon dioxide ($CO_2$) gas feeding line 26 and the mixed gas ($N_2/H_2$) feeding line 27, respectively, such that the parameters such as the carbon dioxide gas concentration monitored by the gas concentration monitor 41 are adjusted at the values predetermined by the operator. Then, the gas flow controllers 30 and 31, each having received the commanding value, control the opening amounts of the controlling valves 28 and 29, and thereby carbon dioxide gas and $N_2/H_2$ gas are fed into the circulating gas in accordance with the valve-opening amounts.

After this, the above-described components in the circulating gas are mixed in the oxyhydrogen reaction system 22 to react oxygen with hydrogen in the oxyhydrogen reactor in the presence of a noble metal catalyst. Hereupon, since the noble metal catalyst and the circulating gas are heated by the preheater 33*a* and the main heater 33*b*, and since the noble metal catalyst comprises a carrier, carbon dioxide gas adsorption onto the noble metal catalyst can be sufficiently prevented. After oxygen is removed while included in water molecules according to the above-described oxyhydrogen reaction, the water molecules are cooled and condensed in the steam separation system 23, and drained into the drain tank 38 after being stored in the steam separator 36. Meanwhile, the circulating gas present in the upper phase of the steam separator 36 is fed into the hermetic box 1 from the gas circulator 2 through the gas-discharging pipe 39.

According to the above-described manner, in the underground environment, while the circulating gas is circulated between the hermetic box 1 and the gas circulator 2, oxygen is removed, the carbon dioxide gas concentration is monitored, and carbon dioxide gas is fed into the circulation gas such that its concentration reaches a predetermined level. As a result, an accurate underground environment with an optionally controlled carbon dioxide gas concentration (1 ppm to 50%) can be simulated in the hermetic box 1.

Additionally, when methane gas should be present in the simulated underground environment, $N_2/H_2$ gas in an amount highly excessive relative to that of oxygen is fed from the mixed gas ($N_2/H_2$) feeding line 27, and methane gas is produced through the side reaction between carbon dioxide gas and hydrogen gas in the oxyhydrogen reactor 34. According to this manner, methane gas which is frequently present in natural underground environments can be produced in the underground-environment simulator, and therefore, the underground-environment simulator can more accurately simulate underground environments. For example, many gas fields or the like have methane gas pressures of 300 atm or more and carbon dioxide gas concentrations of a few percent to 10 plus a few percent, and the underground-environment simulator according to the present invention can sufficiently accurately simulate such underground environments since the carbon dioxide concentration can be controlled within a range of 1 ppm to 50% even in a condition containing methane gas under ordinary pressure.

Incidentally, although a case using nitrogen gas as an inert gas has been illustrated in this embodiment, other inert gases such as helium gas can also be used in place of nitrogen gas. Further, the underground-environment simulator of this embodiment is also applicable to fields such as non-industrial waste/industrial waste disposal, metallic fuel and experiments using metallic sodium, in addition to the field of nuclear power which requires simulation of environments for disposal of radioactive wastes. Additionally, although a hermetic box 1 is used in this embodiment, the material of the hermetic box is not especially limited so long as the atmosphere of the hermetic box 1 can be isolated from the surroundings. For example, the hermetic box may comprise plate materials such as metallic or acryl materials, and sealing members such as O ring packing.

Figure 4:
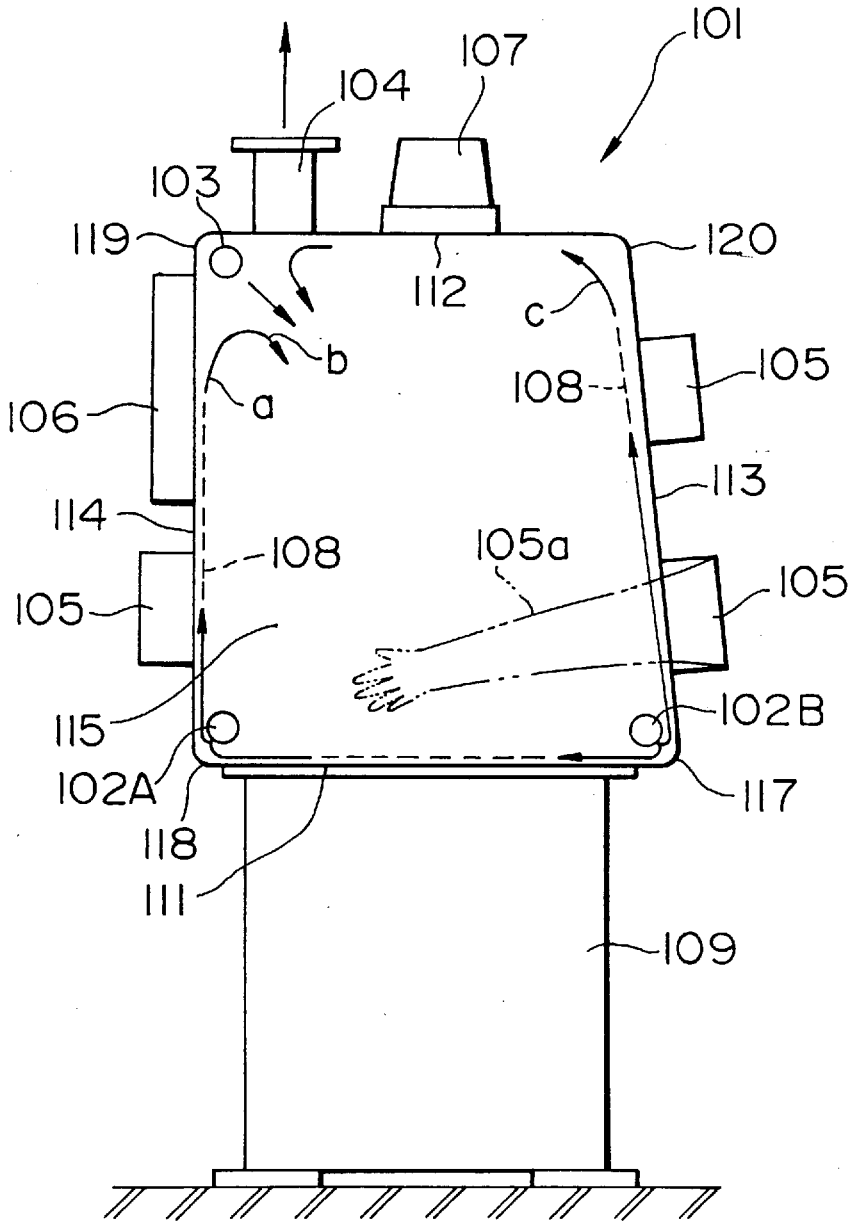
FIG. 4 is a schematic left-side perspective view of an example hermetic box in relation to the present invention.
Figure 5:
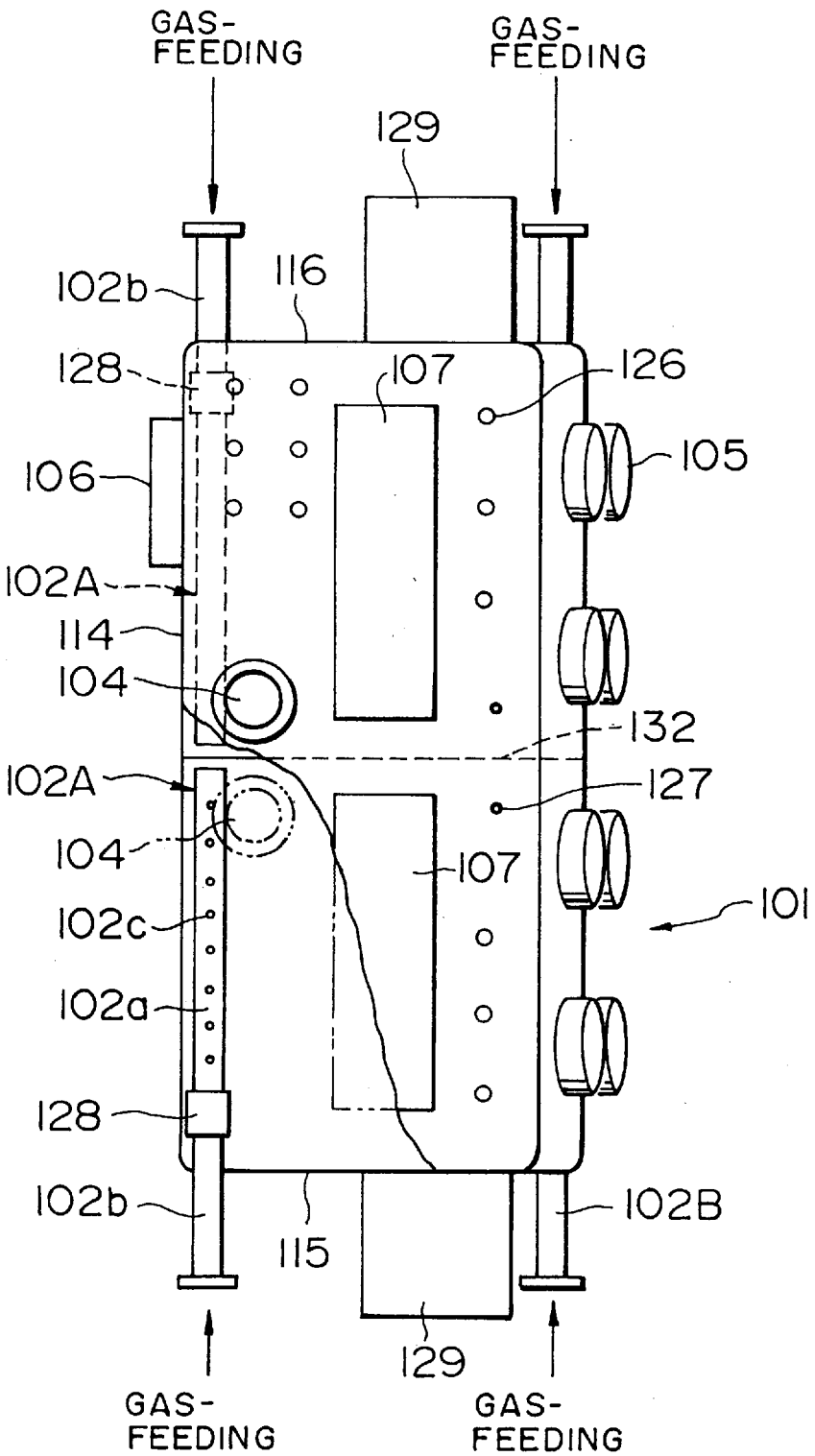
FIG. 5 is a schematic perspective top plan view of an example hermetic box in relation to the present invention.

Next, a structural example of a hermetic box 101 used in the present invention will be illustrated below with reference to FIGS. 4 and 5. FIG. 4 is a left side view of the hermetic box 1, and FIG. 5 is a top plan view of the same. As shown in FIGS. 4 and 5, the hermetic box 101 has a prismatic structure comprising six panels, namely, a bottom panel 111, a top panel 112, a front upright panel 113, a back upright panel 114, a left upright panel 115 and a non-illustrated right upright panel 116.

The hermetic box 101 is equipped with the following members in order to function as an atmosphere controlling unit, and to serve conditions for experiments performed inside the box: A first feeding pipe 102A, a second feeding pipe 102B, a gas-jetting pipe 103, an exhaust pipe 104, glove-fitting openings 105, a monitoring window 106, and a fluorescent lamp 107. Further, the hermetic box 101 is supported on the top surface of a stand 109. In this example, the inside of the hermetic box 101 is divided into two spaces by a partition 132 at the center of the box. The partition 132 has a non-illustrated door through which the atmospheres of the divided two spaces can intercommunicate.

The feeding pipes 102A and 102B are members of the gas feeding means for feeding gas such as nitrogen into the hermetic box 101, comprise hollow pipes or the like, and are connected to a non-illustrated feeding line outside the hermetic box 101.

The gas-jetting pipe 103 is included in the gas feeding means, produces jet of gas, and is connected to the non-illustrated feeding line.

The exhaust pipe 104 is included in an exhausting means, and serves as exhausting the hermetic box 101. Additionally, the exhaust pipe 104 is connected to a non-illustrated gas-controlling unit, and prevents leakage of harmful radioactive materials or the like from the hermetic box 101 by appropriately maintaining the negative pressure inside the hermetic box 101.

A plurality of the glove-fitting openings 105 are provided in the front panel and the back panel of the hermetic box 101 in the manner of protruding from the hermetic box 101. Gloves 105*a* to be fitted to the glove-fitting openings with a sealing material comprise a soft rubber material or the like, and operators of experiments can insert their arms inside the hermetic box 101 through the gloves to treat radioactive materials, instruments and other articles placed inside the hermetic box 101.

The monitoring window 106 is a member for observing and monitoring the inside of the hermetic box 101, and is provided in the back panel of the hermetic box 101 using a sealing material. In this structural example, a round window is employed as the monitoring window 106.

The fluorescent light 107 illuminates the inside the hermetic box 101, and achieves easy inside monitoring. In this structural example, a transparent body for illuminating the inside the hermetic box 101 is attached to the top panel of the hermetic box 101 using a sealing material.

As described above, many members are provided in the panels constituting the hermetic box 101, and the members are attached with intervening sealing portions contacting the panels of the hermetic box 101 such that entering of the outside air is prevented. Oxygen and other molecules in atmospheric air can, however, enter the hermetic box through the texture of the sealing materials such as natural rubber and neoprene constituting the sealing portions, and further, deterioration or the like in the sealing portion can cause leakage of the outside gas into the hermetic box. As a result, gas concentrations readily become uneven in positions close to the panels inside the hermetic box 101. Moreover, a gas does not readily flow at the corners of the hermetic box 101 formed between the bottom panel 111 or the top panel 112 and the upright panels 113 to 116, and therefore, the gas flow readily drifts toward the center of the hermetic box 101.

In order to solve such problems, the first feeding pipe 102A and the second feeding pipe 102B are disposed at the lower corners of the hermetic box 101.

In this structural example, the first feeding pipe 102A is disposed at the corner 117 formed between the panel 111 and the panel 113 in the hermetic box 101, the second feeding pipe 102B is disposed at the corner 118 formed between the panel 111 and the panel 114, and each pipe lies in the direction perpendicular to the drawing sheet of FIG. 4. On the surfaces of the first feeding pipe 102A and the second feeding pipe 102B, small orifices such as small holes for jetting gas are formed along the pipe in the direction perpendicular to the drawing sheet of FIG. 4, and serve as gas-jetting orifices 102*c*.

In this structural example, the gas from the gas-jetting orifices 102*c* jets out in the directions toward the corners 117 and 118.

The first feeding pipe 102A and the second feeding pipe 102B in lower portions of the prismatic structure of the box should be disposed such that the gas jet from the gas-jetting orifices 102*c* form upward gas flows along at lest two panels among the upright panels of the hermetic box 101, wherein said at least two panels are selected in the order of surface area largeness. Since the panels having larger surface areas possibly have a larger number of sealing portions, unevenness in gas concentrations due to the above-described leakage of the outside gas readily occurs near such panels in the hermetic box 101. The gas concentrations can be made uniform by generating upward gas flows to forcedly circulate the gas.

According to this structural example, a gas is fed through the first feeding pipe 102A, and some of the gas jetted from the gas-jetting orifices 102*c* toward the corner 118 is made to flow upward from the corner 118 in the bottom portion along the back upright panel 114, while other of the jetted gas is made to flow along the bottom panel 111. As to the gas fed through the second feeding pipe 102B, some of the gas jetted from the gas-jetting orifices 102*c* toward the corner 117 is made to flow upward from the corner 117 in the bottom portion along the front upright panel 113, while other of the jetted gas is made to flow along the bottom panel 111. In other words, by arranging the feeding pipes according to the above-described manner, a flow path 108 of gas circulating along the bottom panel 111 and the upright panels 113 and 114 is formed in the hermetic box 101, and the gas can circulate in the manner of a continuous gas flow 108 along a major part (50% or more) of the internal surface of the hermetic box 101.

Further, in this structural example, the gas-jetting pipe 103 is disposed so as to lie in the direction perpendicular to the drawing sheet of FIG. 4 at the corner 119 formed between the top panel 112 and the back panel 114 of the hermetic box 101. Similar to the first feeding pipe 102A and the second feeding pipe 102B, a large number of gas-jetting orifices are formed along the pipe in the direction perpendicular to the drawing sheet of FIG. 4 on the surfaces of the gas-jetting pipe 103.

The gas-jetting pipe 103 is arranged such that a gas is jetted through the gas-jetting orifices toward the corner 117 diagonal to the corner 119.

By arranging the gas-jetting pipe 103 in this manner, the upward gas flow a jetted from the aforementioned first feeding pipe 102A can prevent gas stagnation around the upper portion of the prismatic structure of the box where the gas-jetting pipe 103 is disposed, and said gas flow is bent in the direction of b near the corner 119. As a result, the upward gas flow a from the aforementioned first feeding pipe 102A can be a circulating flow without generation of an adrift flow near the corner 119.

Incidentally, in this structural example, since the front panel 113 of the hermetic box 101 slants upward toward the back, the gas flow C can smoothly circulate through the portion near the corner 120 in the upper-front of the prismatic structure of the box, and therefore, an adrift flow is rarely generated near the corner 120.

Moreover, in this structural example, the exhaust pipe 104 is disposed on the top panel 112 of the hermetic box 101. Although the exhaust pipe 104 is placed in the upper portion of the prismatic structure of the hermetic box, it should be optimally placed so as to form an upward gas flow 108 along the aforementioned upright panel.

As shown in this structural example, the upward gas flow 108 which serves to reduce the generation of adrift flow at the upper corner of the hermetic box 101 can be generated by placing the exhaust pipe 104 not at the center of the top panel 112 of the hermetic box 101 but near the back panel 114 and left-side upright panel 115.

Next, the detailed structures of the feeding pipes 102A and 102B will be illustrated with reference to FIG. 5, which is a top plan view of the hermetic box 101. The first feeding pipe 102A is constituted with a part 102*a* placed inside the hermetic box 101 and a part 102*b* placed outside the hermetic box 101. The gas-jetting orifices 102*c* are formed on the surface of the structural part 102*a* of the first feeding pipe 102A along the pipe. Incidentally, FIG. 5 only schematically shows an appearance of the surface of the first feeding pipe 102A on which the gas-jetting orifices are formed along the pipe, and the gas-jetting orifices 102*c* are formed in the positions as described above which cannot be seen from the upper side.

The parts 102*a* and 102*b* of the first feeding pipe 102A are joined with a joint 128. As to the manner of joining with the joint 128, for example, the joint 128 is formed so as to have an internal thread structure at both its ends, and the parts 102*a* and 102*b* are threaded into the ends. According to this manner, the part 102*b* outside the hermetic box 101 can be fixedly positioned relative to the joint 128, while the part 102*a* inside the hermetic box 101 can be rotatable in accordance with the threaded position relative to the joint 128. As a result, since the facing direction of the gas-jetting orifice 102*c* can be varied at will, namely, the direction of jetted gas is variable, the direction of jetted gas can be controlled in consideration of dead spaces relating to the shapes and sizes of the articles carried in the hermetic box 101, the shape of the hermetic box 101 itself, and other factors.

Additionally, connectors 126 such as for connecting laboratory equipment placed inside the hermetic box 101 to power supply units and for sending data to external measurement-processing equipment, and sensors 127 for monitoring internal gas atmospheres are provided on the top panel and side panels of the hermetic box 101.

Further, in order to isolate the atmosphere inside the hermetic box from the surroundings, sealing portions are present at the places where the feeding pipes 102A and 102B are inserted from the outside to the inside of the hermetic box 101, or the connectors 126 and sensors 127 are attached to the hermetic box 101.

Moreover, an air lock 129 is provided for carrying articles into the hermetic box 101. The air lock 129 should have a structure which maintains the components of the atmosphere in the hermetic box 101. For example, the air lock may have a structure with a pair of doors, an article is carried into the space between the pair of doors through the external door while the internal door is closed, the space is then sealed, and the article is carried into the hermetic box 101 through the internal door.

Figure 6:
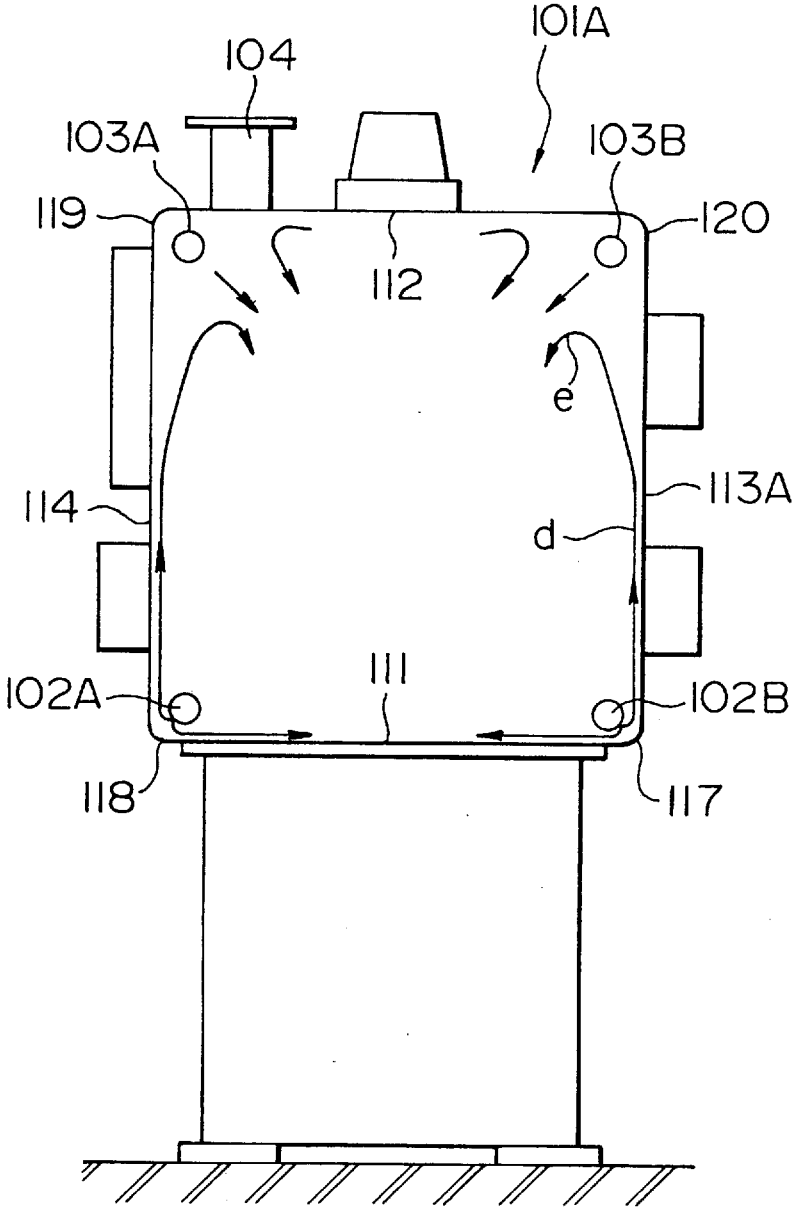
FIGS. 6 and 7 are schematic side elevational views of hermetic boxes in relation to the present invention.

FIG. 6 shows another structural example of a hermetic box, and the hermetic box 101A without a slant panel has two gas-jetting pipes 103A and 103B in its upper portion.

In the prismatic structure of the hermetic box 101A, both the front upright panel 113A and the back upright panel 114 are perpendicular to the bottom panel 111, and it is necessary to provide gas-jetting pipes 103 in both upper-front and back portions of the prismatic structure, namely, at the corners 119 and 120. Accordingly, in this case, a gas is jetted from the second gas-jetting pipe 103B disposed at the upper-front corner 120 of the hermetic box 101, and thereby, the upward gas flow d jetted from the second feeding pipe 102B disposed at the lower-front corner 117 is also bent in the direction of e near the corner 120. As a result, the gas can circulate without generation of an adrift flow around the upper-front corner 120.

Figure 7:
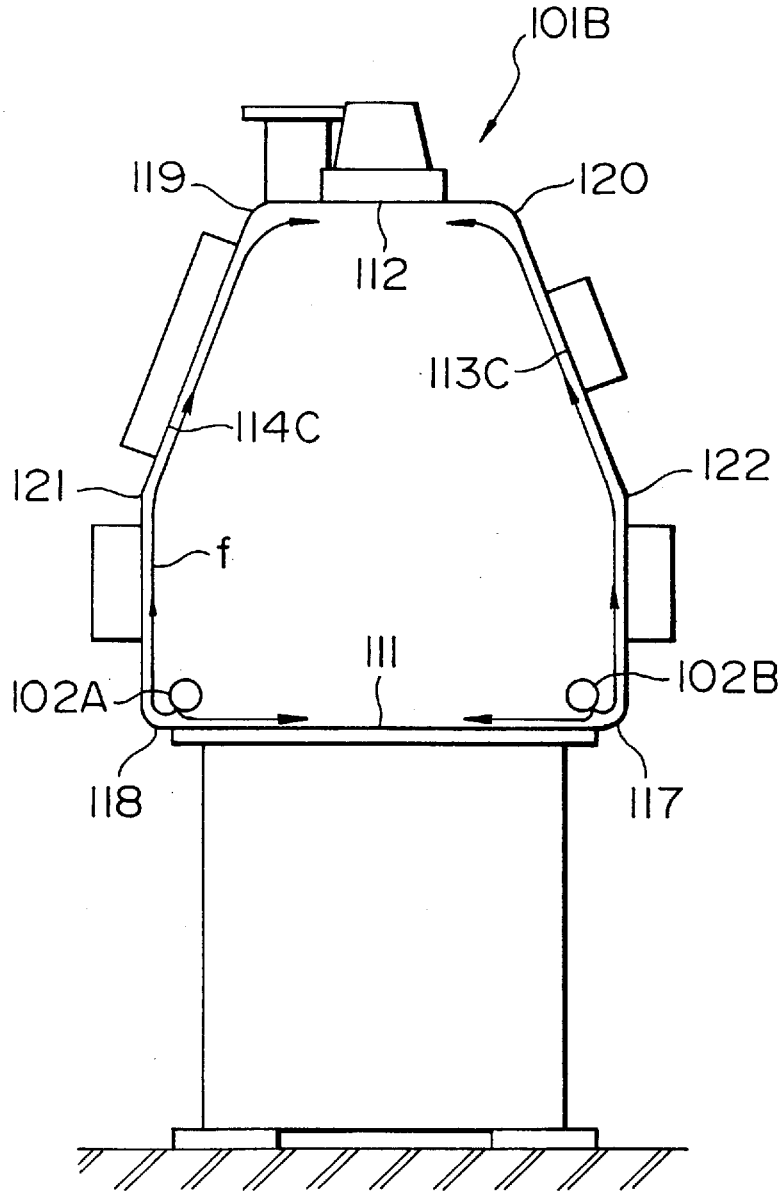

FIG. 7 shows another structural example of a hermetic box 101B in which a front upright panel 113C and the back upright panel 114C slant in their upper portions.

The upright panels 113C and 114C slant from the inflection points 122 and 121, respectively. The upward gas flows jetted from the first feeding pipe 102A and the second feeding pipe 120B form gas flow paths f along the upright panels 113C and 114C, respectively. Accordingly, when the upright panels are arranged so as to slant in their upper portions, circular gas flows slanting from the inflection points 121 and 122 along the upright panels are formed, and therefore, adrift flows are rarely generated around the corners 119 and 120.

Figure 8:
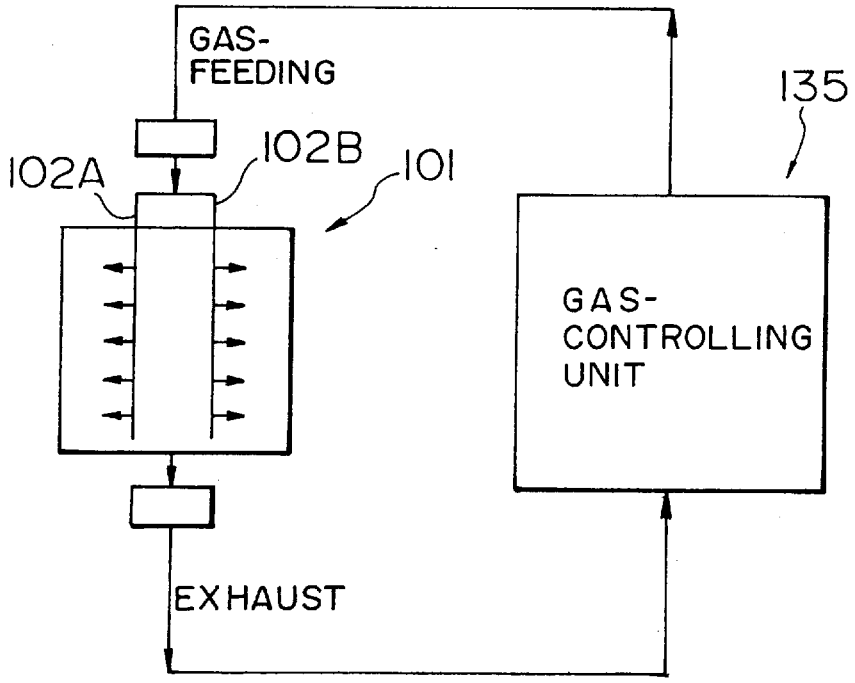
FIG. 8 is a schematic view showing an example system for operation of a hermetic box in relation to FIG. 7.

FIG. 8 schematically shows a structural example of a system for operating the hermetic box of the underground-environment simulator according to the present invention.

From a gas-controlling unit 135, a gas prepared so as to have a predetermined composition is fed into the hermetic box 101 through the first feeding pipe 102A and the second feeding pipe 102B.

Further, the hermetic box 101 is exhausted by the gas-controlling unit 135, and has a structure in which an appropriate negative pressure is maintained.

In the above-described structural examples, cases where the hermetic box of the underground-environment simulator was used for treating radioactive materials were considered, and specifically, a case where the inside of the box was maintained at a negative pressure was mainly illustrated. Similar to such examples, even in cases where the pressure inside the hermetic box is positive, the atmosphere inside the box is isolated from the surroundings in order to maintain the components in the atmosphere at constant levels.

Further, although a case where oxygen was a gas component to be controlled in the underground-environment simulator was mainly illustrated above, the atmosphere inside the box is similarly isolated from the surroundings to maintain the components in the atmosphere at constant levels even in cases where the gas component to be controlled is carbon dioxide gas, methane gas, hydrogen gas or the like, or the gas contains fine particles such as dust.

Accordingly, the present invention is generally applicable to fields such as experiments which require isolating the atmosphere inside the hermetic box from the surroundings and maintaining the components in the atmosphere at constant levels.

Examples of such fields other than the field of nuclear power accompanied by treatment of radioactive materials include the fields of biology, chemistry, metallic fuels, semiconductors, and others.

Next, a practical example of a hermetic box of an underground-environment simulator according to the present invention will be illustrated below.

Using a hermetic box based on FIG. 4, an underground-environment simulator according to the present invention was operated, and the time period needed until the internal atmosphere became stable was measured and compared with that in a case of a conventional underground-environment simulator. Hereupon, the volume of the box was approximately 2 $m^3$, the flow of nitrogen gas fed into the box in a manner of once-through was 8 $Nm^3/h$, and the oxygen concentration in the nitrogen gas was approximately 1 ppm. In this experiment, the oxygen concentration at the outlet of the box was 10 ppm or below.

With the conventional underground-environment simulator, it took approximately 3 to 4 hours from the start of operating the simulator until the gas concentration became constant and the atmosphere became stable.

On the other hand, with the underground-environment simulator according to the present invention, it took approximately 1 hour from the start of operating the simulator up to achieving a stable atmosphere similar to that by the conventional simulator.

According to the construction of the present invention, therefore, a constant gas concentration and a stable internal atmosphere can be achieved within a sufficiently shorter time period as compared with the conventional one.

What is claimed is:

1. An underground-environment simulator comprising:

a hermetic box, the internal atmosphere of which is isolated from the surroundings and controlled with a circulating gas;

an inert gas feeding unit which feeds an inert gas into said circulating gas;

a concentration measuring means for measuring the concentration of each gas component in said circulating gas;

an oxyhydrogen reactor having a noble metal catalyst, in which hydrogen fed in response to the oxygen concentration in the circulating gas is reacted with the oxygen; and a carbon dioxide gas feeding means which feeds carbon dioxide gas into said circulating gas so as to achieve a predetermined carbon dioxide gas concentration in said circulating gas.

2. The underground-environment simulator according to claim 1, wherein:

said box has a prismatic structure, and is equipped with a gas-feeding means disposed in the lower portion of said prismatic structure and a gas-discharging means disposed in the upper portion of said prismatic structure; and said gas-feeding means is formed so as to generate upward gas flows along at least two panels among the upright panels constituting the side walls of said prismatic structure.

3. The underground-environment simulator according to claim 2, wherein said gas-feeding means includes a part which is disposed at at least one corner among the upper corners of said prismatic structure where said gas flows come to, and generates gas jets agitating at least one of said gas flows.

4. The underground-environment simulator according to claim 2, wherein said prismatic structure slants in its upper portion so as to bend at least one of said gas flows.

5. The underground-environment simulator according to claim 2, wherein said gas-feeding means comprise pipes disposed at corners in said prismatic structure, and gas-jetting orifices are formed along said pipes.

6. The underground-environment simulator according to claim 5, wherein portions of said pipes placed inside said prismatic structure are rotatable.

7. The underground-environment simulator according to claim 1, further comprising a heating means for said noble metal catalyst and said circulating gas in said oxyhydrogen reactor.

8. The underground-environment simulator according to claim 1, wherein said noble metal catalyst in said oxyhydrogen reactor comprises an inorganic carrier which has a specific surface of 250 $m^2/g$ or below.

9. The underground-environment simulator according to claim 1, wherein an excessive amount of hydrogen is fed into said circulating gas to generate methane gas through a side reaction between hydrogen and carbon dioxide gas in said oxyhydrogen reactor, and the methane gas concentration is controllable.

* * * * *